United States Patent [19]

Luhn et al.

[11] Patent Number: 4,543,927

[45] Date of Patent: Oct. 1, 1985

[54] ENGINE CONTROL CIRCUIT

[75] Inventors: Dennis A. Luhn, Richfield; Daniel A. Norrick, Anoka, both of Minn.

[73] Assignee: McGraw-Edison Company, Rolling Meadows, Ill.

[21] Appl. No.: 559,527

[22] Filed: Dec. 8, 1983

[51] Int. Cl.[4] ..... F01L 13/08

[52] U.S. Cl. ..... 123/182; 123/90.16; 123/192 R

[58] Field of Search ..... 123/90.11, 90.16, 182, 123/198 DC, 320, 321, 322, 192 R

[56] References Cited

U.S. PATENT DOCUMENTS

| | | | |
|---|---|---|---|
| 2,098,115 | 11/1937 | Voorhies | 123/182 |
| 2,137,482 | 11/1938 | Gil | 123/182 |
| 3,057,336 | 10/1962 | Hatz, Jr. | 123/182 |
| 3,223,076 | 12/1965 | Isoda | 123/182 |
| 4,194,485 | 3/1980 | Stephenson | 123/182 X |
| 4,204,384 | 5/1980 | Holtermann | 123/198 DC X |
| 4,423,709 | 1/1984 | Arrieta | 123/90.11 X |

*Primary Examiner*—Parshotam S. Lall
*Assistant Examiner*—W. R. Wolfe
*Attorney, Agent, or Firm*—James A. Gabala; Jon C. Gealow; Hugh M. Gilroy

[57] ABSTRACT

A control system for an internal combustion engine is described which allows the engine to be started and stopped while unloaded. The invention incorporates the mechanical linkage operated by a solenoid to control a valve at the interior of the engine and an electronic circuit incorporating one or more time delay relays. The invention provides a means of reducing or eliminating the source of vibration resulting from the starting and stopping of a single cylinder diesel engine. Several embodiments are described including one incorporating an integrated circuit timer and one incorporating two time delay relays.

18 Claims, 11 Drawing Figures

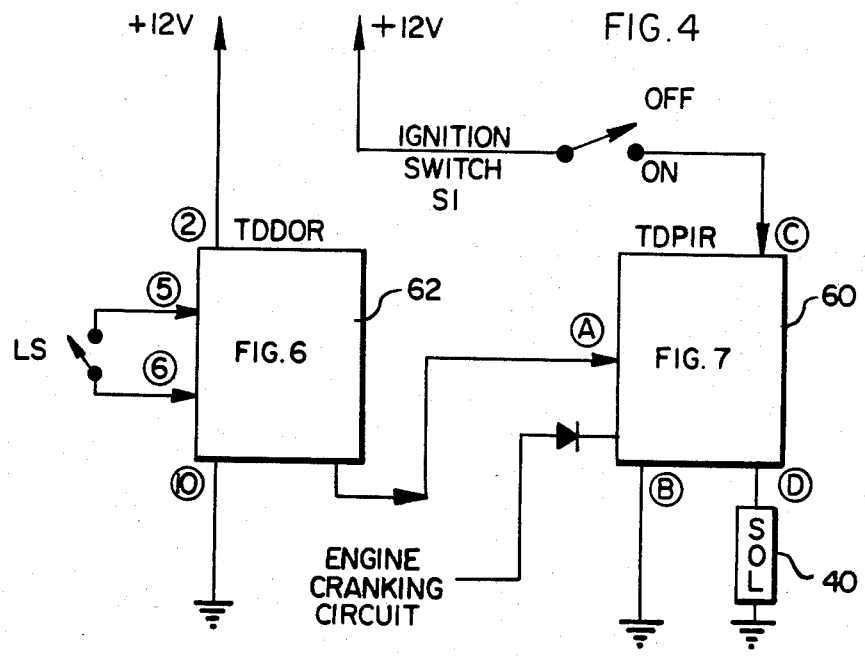
FIG. 5A
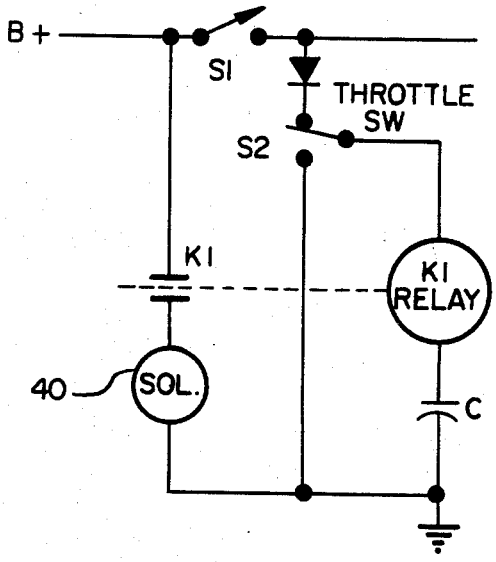
FIG. 5B
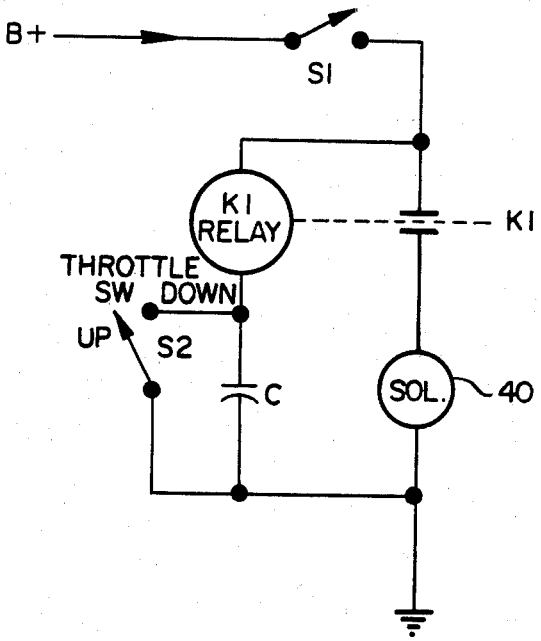

ENGINE CONTROL CIRCUIT

TECHNICAL FIELD

This invention relates generally to internal combustion engines and, more particularly, to a decompression device and control system which is installed on an internal combustion engine in such a manner as to compensate for and reduce the vibration resulting during the start-up and shut-down of the engine.

BACKGROUND OF THE INVENTION

There are several ways to approach the problem of piston engine vibration. The most direct is to reduce it at its source, (i.e., make the engine "smoother operating"). This can be done in a number of ways, such as using multi-cylinder engines, using internal counterbalancing mechanisms, and so on. Unfortunately, all of these approaches tend to add cost to the engine. The simple, single cylinder piston engine remains one of the most cost effective prime movers available. Therefore, an innovative approach to the solution of this problem with regard to a single cylinder piston engine is a matter of some importance.

The second line of defense against engine vibration is the mounting system of the engine on the frame of the vehicle or machine to which it is attached. Again, the most cost effective way is to simply bolt the engine rigidly to the frame and to depend on the mass of the engine to reduce the amplitude of the engine vibration. In vehicles and machines in which the engine is a small part of the overall weight of the machine, this is often an effective solution. However, in lightweight machines (of which typical examples would be consumer/light duty commercial products such as garden tractors and small gensets), the engine comprises a substantial proportion of the overall weight of the machine. In these cases, rigidly fixing a single cylinder piston engine to the machine usually results in levels of vibration which are totally unacceptable to the operator or to the application.

For several years, the predominately accepted compromise to this problem in small lightweight machines, such as garden tractors, has been to use a two cylinder engine which is rigidly mounted to the frame or base of the machine. This has been attractive because of the relatively low cost of multi-cylinder gasoline engines. However, with the advent of small diesel powered commercial products, such as garden tractors, there is a greater need to use a single cylinder engine in an apparatus without an unacceptable level vibration.

Another approach to the problem of excessive vibration, is to use vibration isolating mounting systems. These systems typically consist of a spring element or an elastomeric connection which supports the weight of the engine and, to varying degrees, "isolates" the vibration of the engine. Those skilled in the art know that spring design is controlled by several factors, among them the weight of the engine and the frequency of vibration to be isolated. Typically, the weight of the engine and the vibration frequencies to be isolated are such that the use of a spring, with as low a spring rate as can be achieved, provides the optimum in vibration isolation.

Unfortunately, there are other effects. The secondary effects of using a low spring rate is that the spring mass of the system, comprised of the engine and it's mounting, will have a low natural frequency of vibration. This means that when the engine is exciting the system at that natural frequency, or some multiple of it or some frequency very near to it, the excitation force required to produce large excursions of the engine as supported in the mounting system will be very small. It also means that, when the engine is exciting the system at a low frequency in the range of the natural frequency of the mounts, isolations will be poor and a large amount of the engine's vibration will be conducted through the mounting system to the machine itself. In lightweight machines, such as garden tractors, a significant movement of the machine itself will result—usually to the extent of being objectionable to the operator.

There are two times during the operation of an engine that the engine will pass through that low natural frequency of the mounting system—start-up and shut-down. During those periods, the primary source of vibration energy will be the reaction torques which occur when the engine is coming up against cylinder compression and the engine is exchanging energy between the piston and its flywheel. As the piston comes up on its compression stroke, energy is removed from the flywheel; when the piston comes down on the expansion stroke, energy is returned to the flywheel. The result of this energy exchange is that the rotating system of the engine is alternatively speeding-up and slowing-down (i.e., accelerating an decelerating rotationally) and a reaction torque (i.e., of the engine against the mounting system) is produced. This is not only a significant design problem, not only from the standpoint of efficient packaging, but also from the standpoint of the perception of the equipment operator who may become alarmed by the engine's gyrations. For example, in a small machine, such as a garden tractor, the equipment operator would be jostled about. This is also a problem whenever the equipment operator has an operating station atop or in close contact with the engine. It is also a problem where noise enclosures or other packaging constraints make it necessary or desirable to limit the total excursion of the engine on it's mounting system. This is an especially important problem in view of the recognized energy savings associated with single cylindered diesel engines. Until the public can accept such engines as being safe, an easy to operate and control the energy savings of a diesel engine will be lost from the consumer market. Moreover, the polution associated with ordinary gasoline engines will continue to contaminate the atmosphere. Thus, a significant design problem remains to be solved.

SUMMARY OF THE INVENTION

In accordance with the present invention, a control system is disclosed which operates to reduce or eliminate the vibration associated with the starting-up and shutting-down of a diesel engine. In particular, the control system comprises: a camming means for opening and closing a combustion chamber valve, such as an exhaust valve, in response to the rotation of a control shaft to a pre-selected position; a solenoid means for rotating the control shaft to its pre-selected position upon the energization of a solenoid; a time delay circuit for energizing the solenoid for a pre-selected time interval; and an electrical switch means for supplying electrical power to the time delay circuit when the engine is started and when the engine is shut-down. Thus, by preventing the complete isolation of at least one of the combustion chambers of a diesel engine so that compression is not developed in that combustion chamber, the energy exchange between the cylinder and the flywheel is reduced or eliminated. On shut-down the control system allows the engine to "coast-down" through its critical speeds smoothly without providing the excitation force which has been found, in some cases, to cause large displacements of the engine on its mounting system. On start-up, the control system allows the equipment operator to bring the engine up to a speed which is somewhat above the natural frequency of a mounting system, before allowing the combustion chamber to be isolated for sustained operation.

Several embodiments are described in detail and illustrated in the drawings. In one embodiment, an ignition switch is used to actuate a relay coil in series with an energy storage means, such as a capacitor. The relay closes a contact in series with a solenoid which operates a linkage and cam to prevent the exhaust valve of an engine from completely closing. Once the capacitor becomes completely charged the relay becomes de-energized and the solenoid linkage frees the engine to operate in its normal manner. On shut-down, the capacitor is short circuited, whereupon the solenoid becomes re-energized, and the linkage is operated once again to prevent the exhaust valve of the engine from becoming completely closed. Thus, the engine is started and stopped with its combustion chamber "de-compressed".

In another embodiment, two time delay relays are used—a time delay pull-in relay, and a time delay drop-out relay. When the electrical system of the engine is turned on, a normally closed contact in the pull-in relay energizes the de-compression solenoid, much as described in the first embodiment. After pre-set period or interval, the normally closed contact opens and the decompression solenoid is de-energized. The input to the pull-in relay is maintained by a micro-switch on the engine throttle through a connection in the time delay drop-out relay. Therefore, when the engine is throttled down, and after a pre-set time delay in the drop-out relay, the time delay pull-in relay resets thereby re-energizing the compression solenoid. Finally, when the ignition is shut-off the circuit is reset for the next cycle.

In still another embodiment of the invention an integrated circuit timer and two relays are used to activate the de-compression solenoid during start-up and shut-down of the engine. The integrated circuit is configured to operate as a monostable. When the engine is started the monostable is activated to operate the decompression solenoid. After a pre-selected time interval the solenoid is de-energized. The engine is provided with a limit switch which is closed when the throttle is in its high or up position. This limit switch is in series with a second relay which is actuated when the throttle switch is in its high or up position and the ignition switch is placed in its run position. This second relay closes a set of contacts which reset the integrated circuit timer and which charge an energy storage device. An energy storage device is used to operate the timer during engine shut-down. When the engine is to be shut-down, power is removed from the second relay. This removes the reset from the timer. The integrated circuit timer, powered by the energy storage device, then actuates the decompression solenoid much as in the two previous embodiments.

Numerous other advantages and features of the present invention will become readily apparent from the following detailed description of the invention, the embodiments described therein, from the claims, and from the accompanied drawings.

BRIEF DESCRIPTION OF THE DRAWINGS

FIG. 4 is a block diagram of the control circuit, in one embodiment of the invention, used to operate the linkage shown in FIGS. 1, 2 and 3;

FIGS. 5A and 5B are schematic diagrams of another control circuit which may be used in conjunction with the present invention;

DETAILED DESCRIPTION

Figure 1:
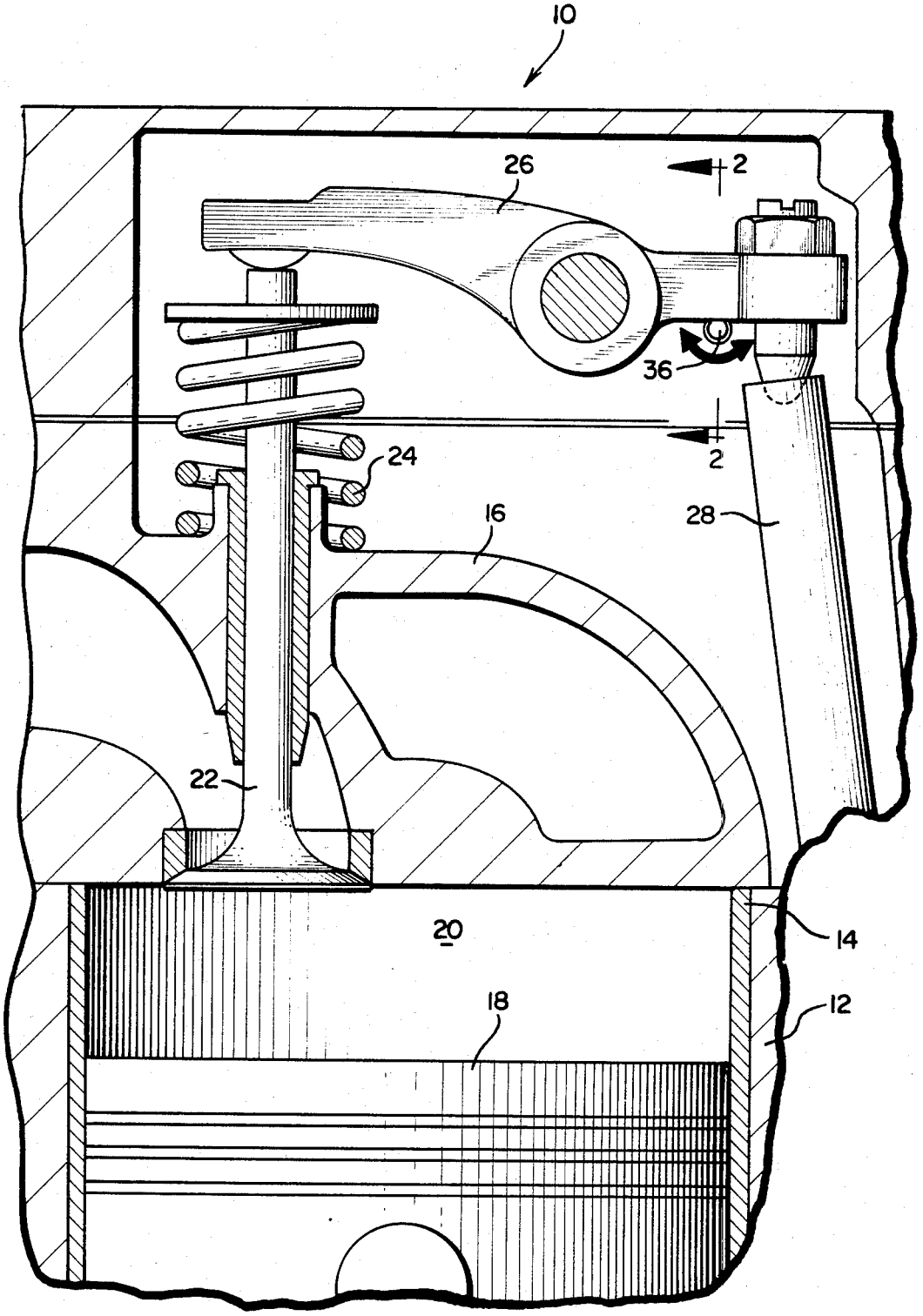
FIG. 1 is a partial, cross-sectional, side elevational view of a diesel engine fitted with the decompression linkage that is the subject of the present invention.

While this invention is suseptible of embodiment in many different forms, there is shown in the drawings and will herein be described in detail several embodiments of the invention. It should be understood, however, that the present disclosure is to be considered as an excemplification of the principles of the invention and is not intended to limit the invention to the specific embodiments illustrated. First the mechanical components will be explained and then the associated electrical control circuit.

Mechanical Components

Referring to the drawings, the upper end or upper works of a single cylinder diesel engine 10 is illustrated in FIG. 1. Shown there is an engine block 12, a cylinder liner 14, a cylinder head 16, and a piston 18. The cylinder liner 14 together with the piston 18 and the head 16 define a combustion chamber 20. In the engine illustrated, the flow of exhaust gases from the combustion chamber 20 is controlled by the operation of an exhaust valve mechanism. The exhaust valve mechanism consists of the a poppet-like valve 22, a spring 24 a rocker arm 26, and a push rod 28. The spring 24 keeps the exhaust valve 22 shut until the rocker arm 26 is rotated counter-clockwise by the push rod 28. This mechanism is housed within a valve cover 30. The push rod 28 is forced to undergo a reciprocating motion through, or as a result of, the operation of a cam shaft driven by the main or drive shaft of the engine 10 in response to the reciprocation motion of the piston 18 in such a manner that a synchronized relationship is maintained.

Figure 2:
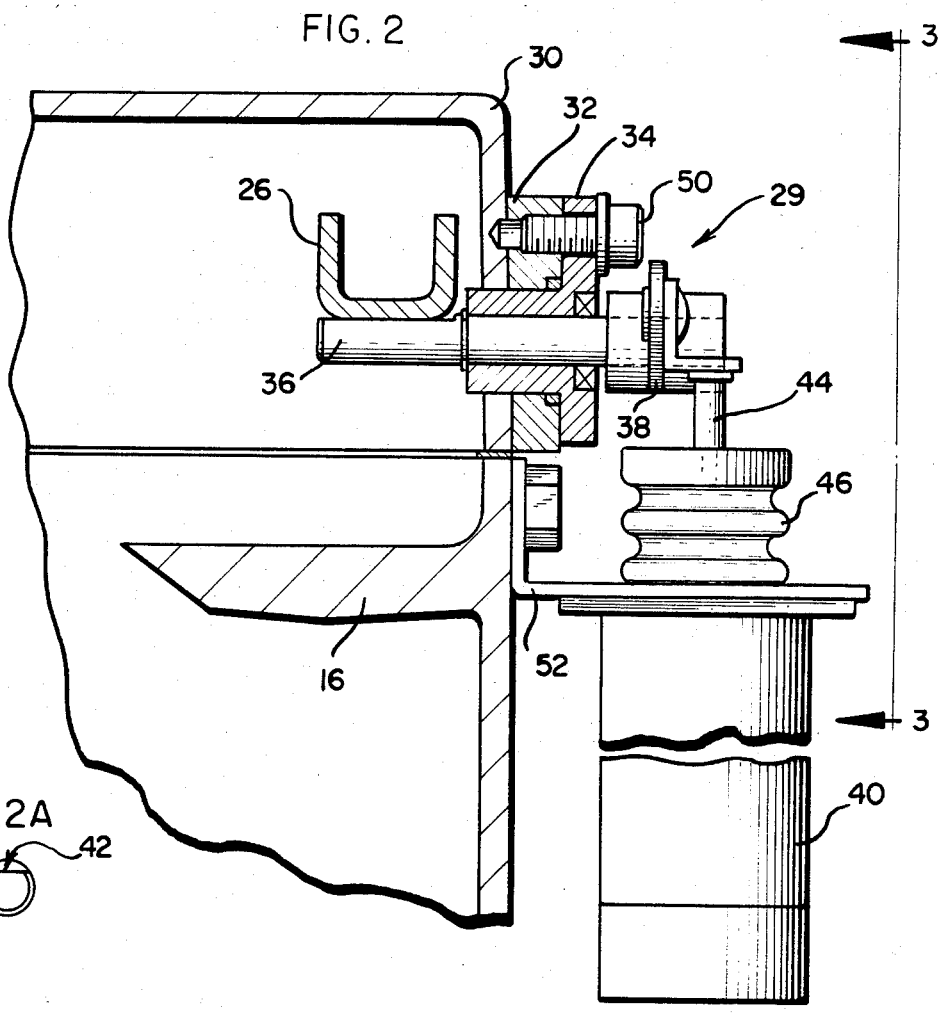
FIG. 2 is a partial, cross-sectional, side elevational view of the apparatus shown in FIG. 1, as viewed along line 2—2 of FIG. 1.
Figure 2A:
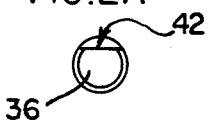
FIG. 2A is a partial side view of the cam shaft shown in FIG. 2 as viewed along line 2A—2A.
Figure 3:
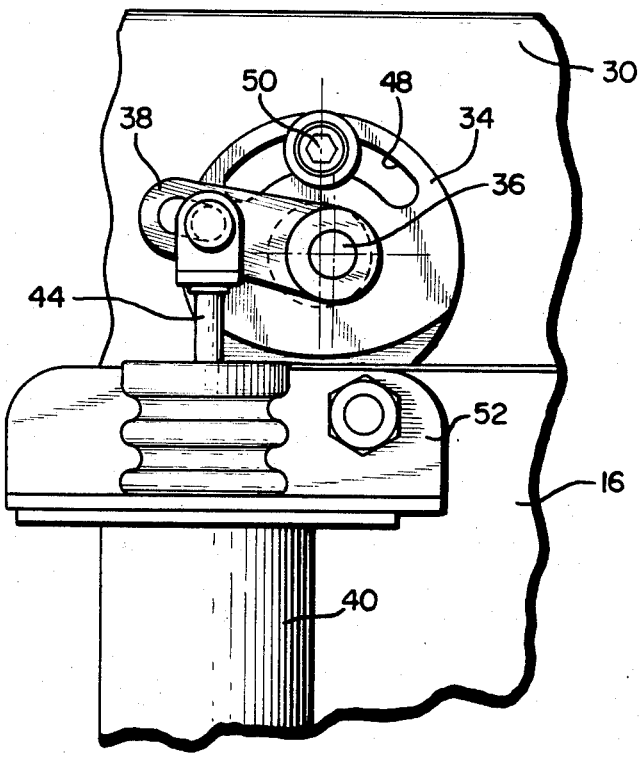
FIG. 3 is a partial side elevational view of the decompression linkage shown in FIG. 2 as viewed along line 3—3.

Turning now to FIG. 2, a mechanism is illustrated, hereinafter referred to as the "decompressor mechanism" 29, which allows one to keep the exhaust valve 22 open despite the operation of the spring 24. Specifically, the decompressor mechanism 29 includes a weldment 32 affixed to one side of the valve cover 30, a busing 34 rotationally mounted within the weldment and valve cover, a cam shaft 36 eccentrically mounted relative to the axes of the bushing (see FIG. 3), a bell crank 38 which is joined to one end of the cam shaft, and an electrical solenoid 40. The solenoid 40 includes a plunger 44 and a rubber boot 46 which houses a spring to hold the plunger in a normally extended position relative to the solenoid coil. The solenoid 40, in this particular embodiment, is attached to the cylinder head 16 of the engine 10, by a bolted bracket 52.

Returning to FIG. 1 it should be clear from the drawing that, when push rod 28 moves upwardly, the rocker arm 26 rotates counter-clockwise so as to move the exhaust valve 22 downwardly. It also should be clear that by holding upwardly that end of the rocker arm 26 which comes in contact with the push rod 28, the exhaust valve 22 will be prevented from fully closing. The cam shaft 36 is an otherwise cylindrical rod which is provided with a flattened portion 42 at one end. When the flatten portion 42 is in its twelve o'clock position (TDC), no inteference is provided with the operation of the rocker arm 26. When the flattened portion 42 is rotated away from the rocker arm 26, the circular exterior surface of the cam shaft 36 comes into contact with the rocker arm. This prevents the valve spring 24 from fully shutting the valve 22. Turning FIG. 3, the upper portion of the bushing 34 is provided with an arcuate section or opening 48 into which a mounting bolt 50 is inserted to hold the busing fixed in position relative to the valve cover weldment 32. By mounting the cam shaft 36 eccentrically relative to bushing 34, the bushing may be rotated within the valve cover weldment 32 so as to adjust the amount that the exhaust valve is opened. This allows adjustments to be made for valve seat wear, production tolerances, etc.

In summary, by electrically activating the solenoid 40, the normal operation of the rocker arm 26 can be overridden and the valve 22, which is opened to the combustion chamber 20 of the engine, can be kept open. More importantly, the piston 18 can be reciprocated without a pressure-force being developed within the combustion chamber 20. This will not only aid starting (as when the engine is cold and the lubricating oil is thick) but will also reduce engine vibration in the manner that was previously explained.

ELECTRICAL COMPONENTS

All diesel engines incorporate some form of control system by which the engine can be operated. There are three basic diesel engine control systems which are most commonly used and which need to be accomodated by any decompressor control. These are generally classed as single lever controls, two lever controls, or electric shut-off controls (hereinafter referred to as "ESO" controls). To be technically correct, an ESO control is a variant of the single lever or two lever controls since it is usually comprised of a solenoid operated valve which activates some part of the mechanical fuel control system. As electronic control if diesel fuel injection becomes commercialized, this will change. The ESO control will then be a more direct form of engine control. In any case, this will not affect the viability of effectiveness of the decompressor mechanism 29 as a measns for vibration control.

With a single lever control system, both engine speed and shut-off are controlled by one lever. Shut-off, in the case of a single lever control, corresponds to "zero speed". That is, the speed control lever is moved to a position beyond the low idle speed setting, at which point is causes the fuel delivery of the injection pump to the combustion chamber 20 to cease, where upon the engine stops running.

In a "two lever control system", one lever controls engine speed and another lever is used as a shut-off control. With this system, it is possible to shut the engine down without returning the speed control lever to any particular position. A typical arrangement for this type of control allows the shut-off lever to "bypass" the speed control mechanism and cause the fuel delivery of the injection pump to cease.

ESO can be incorporated into either of the two control systems specified above. It usually consists of an electrical solenoid incorporated into the injection pump itself or the fuel control system so that, upon activation or deactivation according to the system employed, a solenoid provides the mechanical movement needed to cause the fuel delivery of the injection pump to cease (cf., as opposed to having that motion supplied by the engine equipment operator or person via a mechanical control system). Those skilled in the art, known that ESO is especially popular, in such consumer products such as lawn tractors, because it is easily integrated with an ignition key switch which also controls other functions, such as starter activation and so forth.

The control circuit that about to be described, can be incorporated into any of the three basic diesel engine control systems using appropriate electrical switches and components. In the case of simple mechanical shut-down systems, either of the one or two lever type, all that is required is that an appropriate switch be located so as to be activated by the movement of the mechanical lever that is being used to produce shut-down. Therefore, it is simplist embodiment, the electrical control circuit, used to operate the decompressor mechanism 29, need only consist of a series circuit including a switch connected to a source of power and the solenoid 40. However, in all likelihood, additional circuitry would be incorporated to produce a control logic that avoids battery run down or to provide a time delay for decompression on start-up or shut-down.

Figure 6:
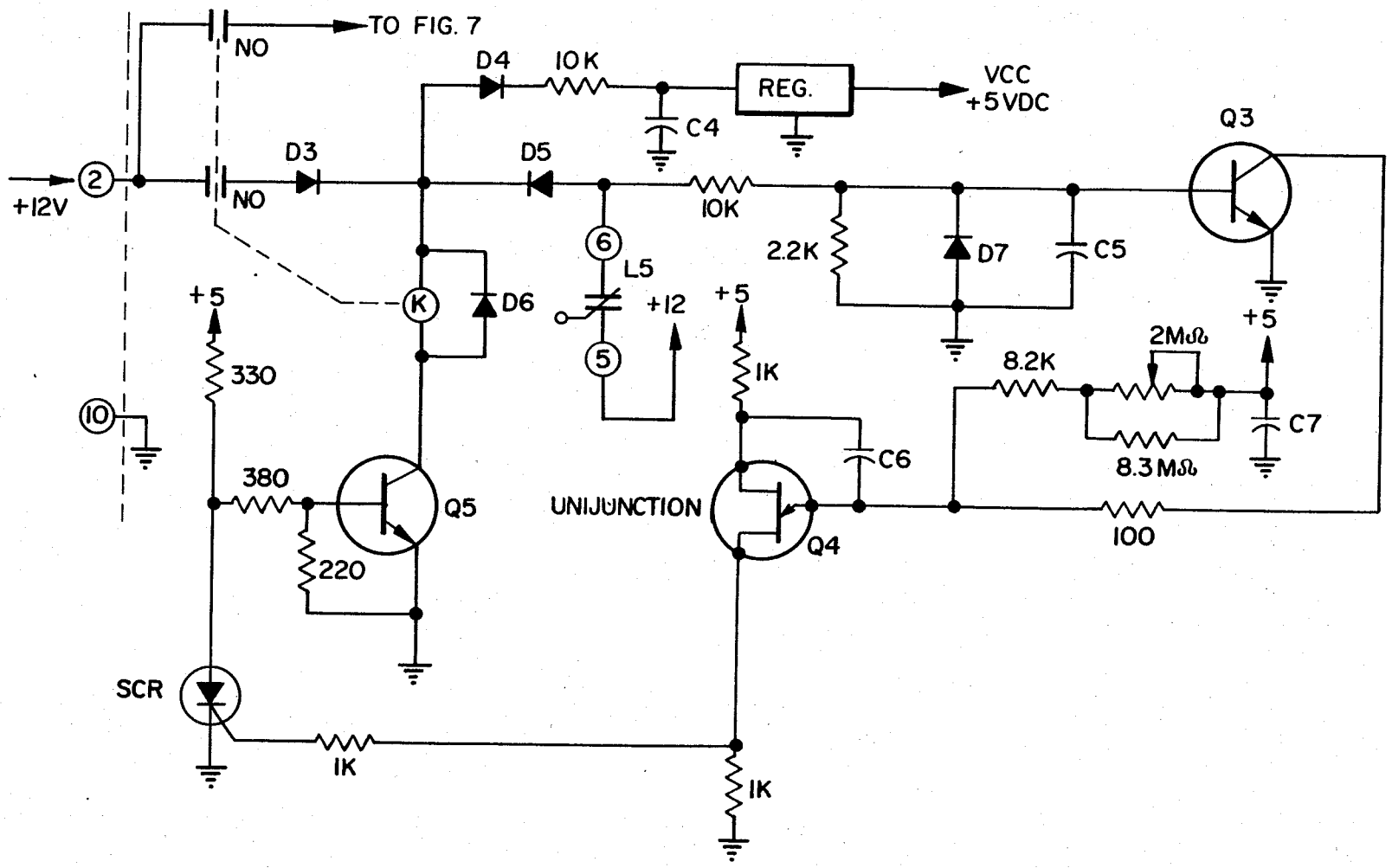
FIGS. 6 and 7 are schematic diagrams of the relays shown in FIG. 4.
Figure 7:
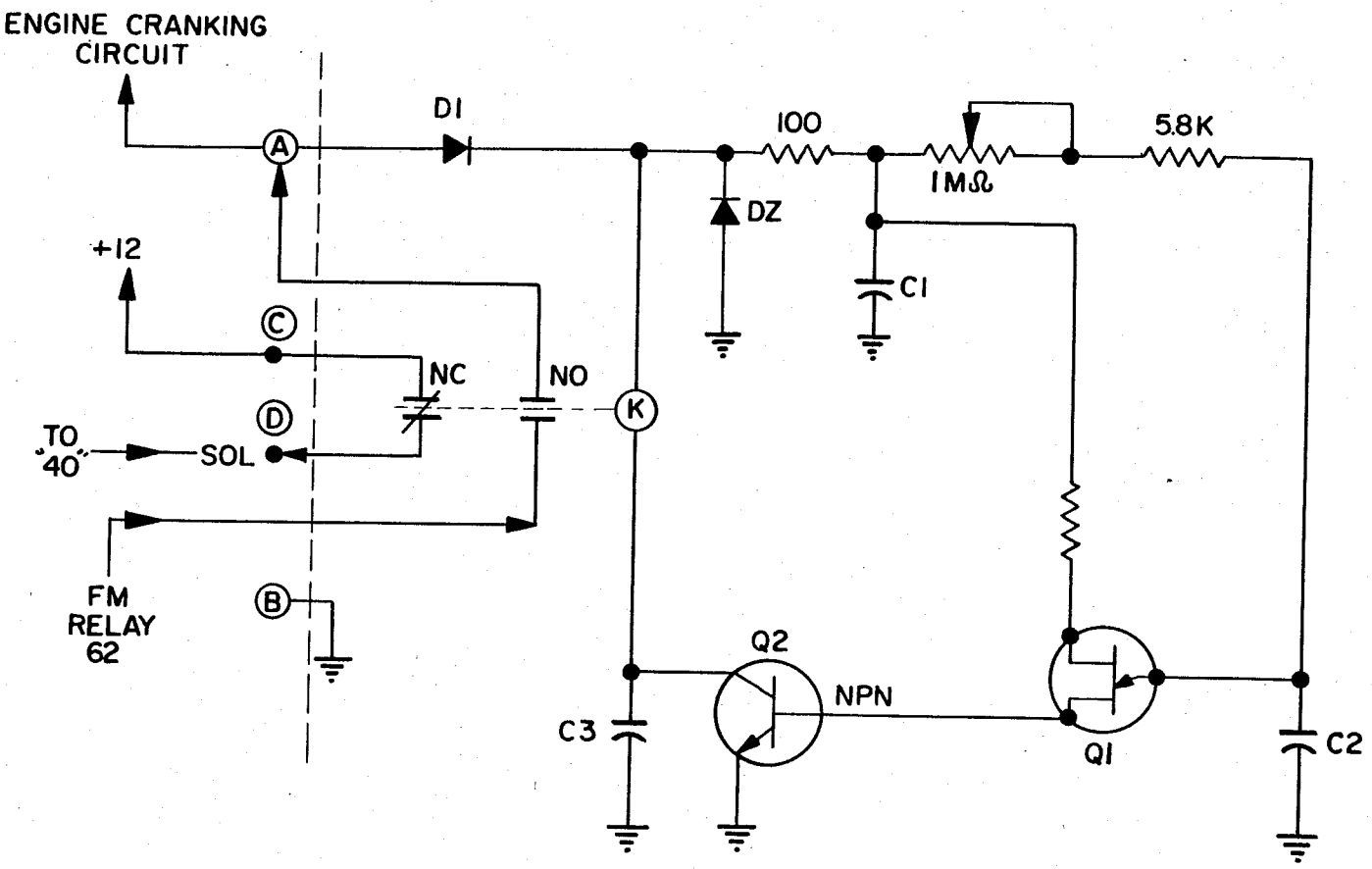

Turning to FIG. 4 an elementary control circuit for the solenoid 40 is illustrated. This control circuit consists of two relays: a time delay pull-in relay 60 and a time delay drop-out relay 62. The time delay pull-in relay 60 is schematically illustrated in FIG. 7; this relay may be alternatively referred to as a "delay on make" relay. The time delay drop-out relay 62 is schematically illustrated in FIG. 6; that relay is alternatively referred to as a "delay on break" relay. Upon application of voltage to the input terminals of the pull-in relay 60 the time delay cycle starts. At the end of the pre-set time delay, the output contacts transfer, either connecting or disconnecting the load. Reset is accomplished by removal of the input voltage. With regard to the drop-out relay 62, voltage is applied to the timer at all times. Upon closure of a normally open control switch LS, the output voltage contacts transfer and remain in that position as long as the switch LS is kept closed. When the control switch LS is opened, timing starts. At the end of a pre-set time delay, the output contacts transfer back to their initial position.

The functional sequence of the circuit of FIG. 4 is as folows:

1. Turning the ignition switch S1 "on", energizes the decompression solenoid 40 through a normally closed contact in the pull-in relay 60.

2. An input from the engine cranking circuit triggers the pull-in relay 60 into operation; this initiates the time delay and opens the normally closed contact in series with the ignition switch S1 and the solenoid 40.

3. The input to the time delay pull-in relay 60 is maintained by an input from time delay drop-out relay 62; as long as the control switch LS on the throttle is kept closed power is supplied.

4. When the throttle is moved down to a shut-off position, the switch LS opens and, after a pre-set time delay, the power is removed from the pull-in relay 60 allowing the pull-in relay to reset; this re-energizes the decompression solenoid 40 for a present time interval.

5. Finally, when the ignition switch S1 is turned off, the solenoid 40 power supply circuit is reset for the next cycle.

It should be understood from the forgoing description that, since the throttle controls the fuel supply to the engine, throttle down is required for stopping the engine. Therefore, in this circuit turning the ignition switch S1 to its off position prior to throttle down will not give decompression on engine shut-down (i.e., no source of power to the solenoid 40). This arrangement however, prevents the battery from being drained to supply power continuously the solenoid 40 when the engine is stopped.

In one specific embodiment a National Controls Corporation Model T3K-10-466 relay, set for zero seconds, was used for the drop-out relay 62 and a model K1K-10-666, set at approximately 10 seconds, was used for the pull-in relay 60. In one engine configuration, the time delay drop-out relay 62 was thought to be necessary since it was believed that decompression should be delayed on shut-down (i.e., until a partial run-down of the engine had occured so as to prevent exhausting unburned combustion gases. This was not found to be necessary after experimentation and study. For this reason the drop-out relay was set for a "zero time delay". In other applications it may be udeful to have this delay (i.e., polution or emissions control, etc.). This arrangement however, does prevent battery drain down even if the ignition switch S1 is kept closed.

Turning to FIG. 6, when the limit switch LS is closed, transistors Q5 and Q3 turn on. This energizes the coil K of the relay which closes the normally open contacts to supply power to maintain the relay temporarily in operation (i.e., after swtich LS opens) and to supply power to the pull-in relay 60 shown in FIG. 7. It also charges a capacitor C6. When the limit switch LS is opened (i.e., engine is throttled down), transistor Q3 is turned off, and the uni-junction transistor Q4 (MU 4893) times out (i.e., capacitor C6 discharges) and fires the SCR after the delay set by the 2 meg-ohm pot. This turns the SCR on and turns transistor Q5 off. This de-energizes the relay coil K and opens the normally open contacts.

Turning to FIG. 7 when power is supplied to the relay (i.e., at terminal A) by the engine cranking circuit, two capacitors C1 and C2 begin to charge. After a time delay, set by a 1 meg-ohm pot, the uni-junction transistor Q1 (MU 4893) is triggered. This turns on a transistor Q2 which causes current to flow through the relay coil K. This closes a normally open contact so as to supply power from the drop-out relay 62 (i.e., in anticipation of a subsequent engine shut-down). It also opens a normally closed contact which was supplying current to the decompression solenoid 40.

A simpler circuit and one that would perform without the necessity of throttling down prior to shutting the ignition switch off, is shown in FIGS. 5A and 5B. Turning to FIG. 5A when the ignition switch S1 is closed and the control switch S2 (on the throttle) is in the up position, the relay K1 is energized an the capacitor C begins to charge. The energization of the relay closes a contact in series with the solenoid 40 which causes the decompressor mechanism 29 to function. When the capacitor C is charged, the relay K de-energizes and the solenoid 40 is shut-off. When it is desired to shut the engine down a switch S2 is moved to the lower or down position. This short circuits the relay coil K through the capacitor C which causes the capacitor to discharge. This, in turn, picks up the relay contact in series with the solenoid 40, thereby achieving decompression on engine shut-down.

Turning to FIG. 5B, the situation is somewhat similar. As before, closing the ignition switch S1 causes the relay coil K to become energized and the decompression solenoid 40 to become energized. After the capacitor C is charged, the relay coil K is de-energized and the solenoid 40 is de-energized. When the throttle switch S2 is moved to its down position, the capacitor C is shorted. This re-energizes the relay coil K immediately. Thus, decompression is achieved on start-up and shut-down of the engine simply by leaving S1 closed and merely operating the throttle switch S2.

Figure 8:
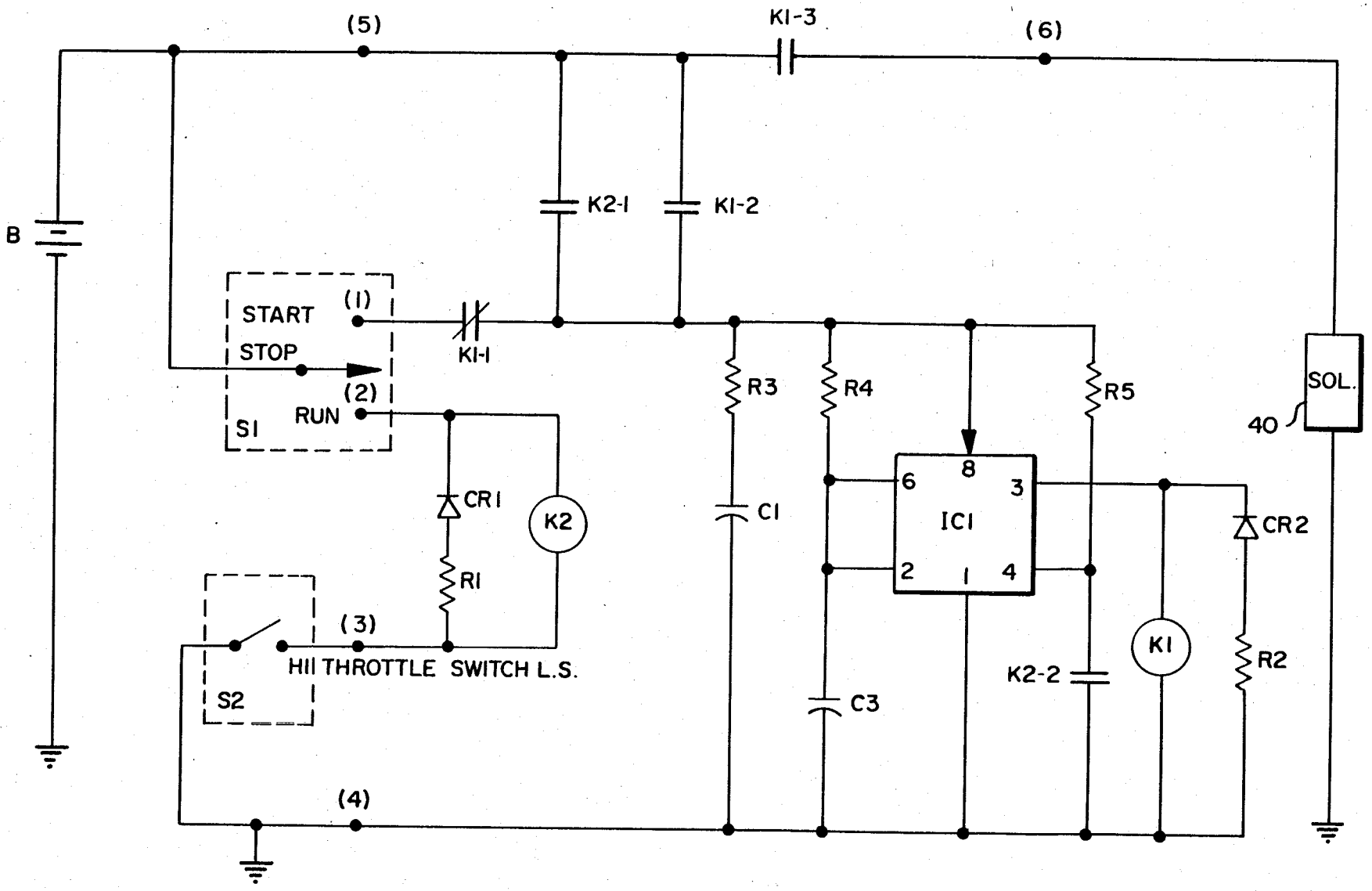
FIG. 8 is still another schematic diagram of a control circuit which may be used in conjunction with the present invention.
Figure 9:
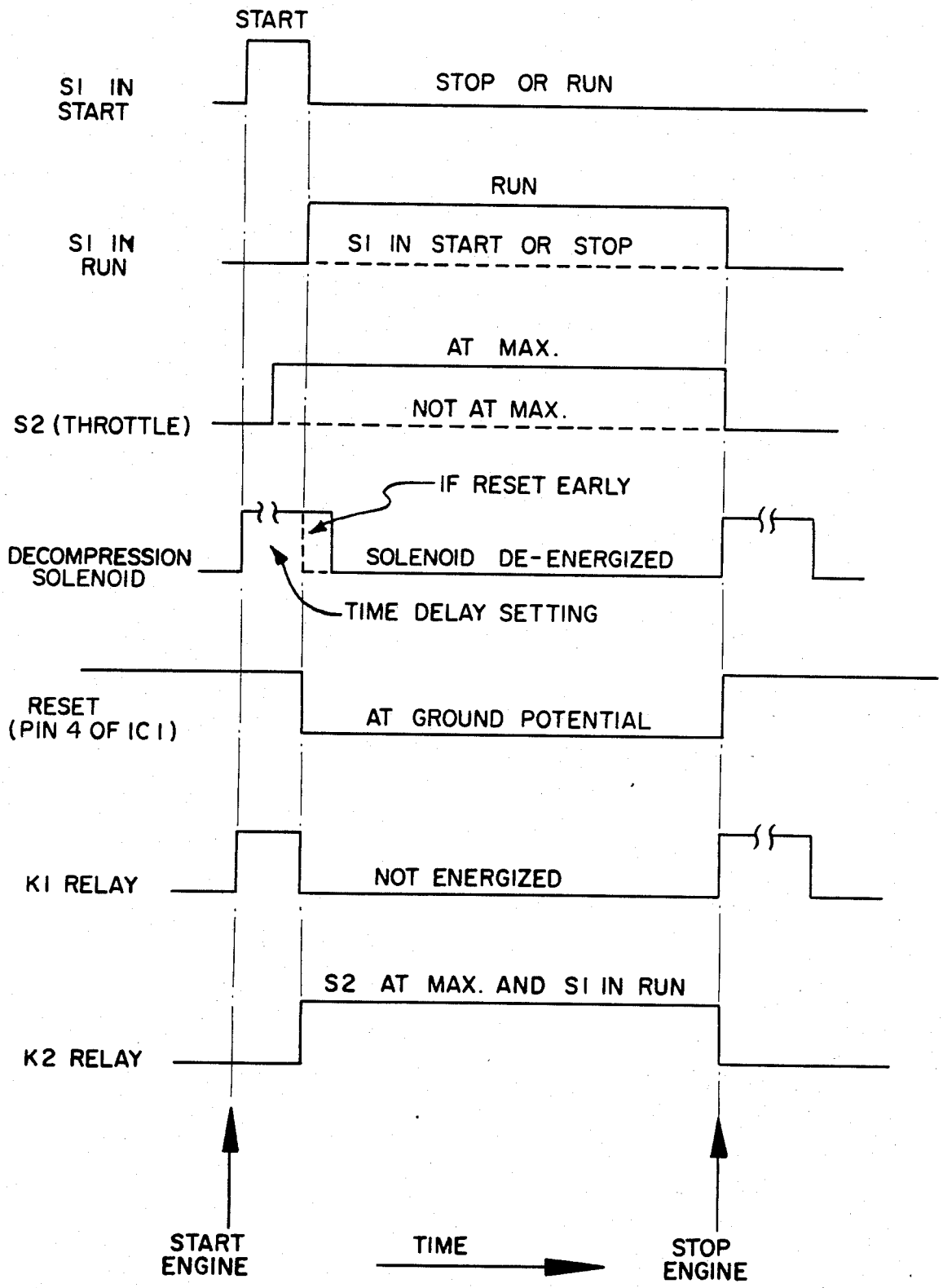
FIG. 9 is a diagram illustrating the sequence of events associated with the control circuit shown in FIG. 8.

Still another embodiment is illustrated in FIG. 8. This is perhaps the perferred embodiment in the case of the completely ESO control system. During the starting sequence, the start/run/stop switch S1 is placed to its "start" position. With an ESO system, S1 would also be ganged with other contacts which operate the starting or cranking motor and the fuel system solenoid. This switch would also be spring loaded away from the start position. This supplies voltage from the battery B to an integrated circuit timer IC1, such as a Signetics 555 timer, through a normally closed contact K1-1. During the brief interval required to energize relay K1, energy is stored in a capacitor C1 for continued operation of the circuit. A resistor R3, in series with the capacitor C1, serves as a current limiting element to limit the inrush current in the capacitor. The resistor R4, capacitor C2, and the integrated circuit timer IC1 are configured as a "power-up monostable" circuit. Upon the application of battery voltage to a control pin 8 of the timer IC1, the monostable is "triggered" and the output pin 3 goes to a "high" condition. A voltage of approximately one volt below battery voltage is then applied to relay coil K1. This energizes the relay K1 for a period of time determined by the time constant of the circuit, approximately equal to 1.1 $R_4 C_3$. When the relay K1 is energized, the normally closed contact K1-1 opens. However, a normally opened relay contact K1-2, which is connected at one side to the battery B, closes; this assures continuation of the application of power to the timer IC1. The energy stored in the capacitor C1 assures continuation of power to the circuit during the opening of the K1-1 contact and the closing of the K1-2 contact. Most importantly, with energization of relay K1, contact K1-3 closes; this supplies power to the decompression solenoid 40. As the time delay, determined by resistor R4 and capacitor C3, is reached, this relay K1 is de-energized. This interrupts power to the timing circuit (i.e., K1-2 opens) and to the decompression solenoid 40. During the starting sequence of the engine, throttle switch S2 is normally closed; therefore, it has no effect on the timing of the decompression solenoid 40.

While the engine is running, the start/stop/run switch S1 is in its "run" position. If the throttle switch S2 is closed, a second relay K2 is energized. This closes a normally opened contact K2-1 which supplies power from the battery to the timer IC1. It also closes a relay contact K2-2 connected between pin 4 of the timer IC1 and ground. Closing this contact K2-2 terminates the timing cycle, if it has not already timed out. In other words, the grounding of pin 4 of the timer IC1 resets the monostable. In addition, it prevents a re-start of the monostable until the start/stop/run switch S1 is moved to its "stop" position.

During the stop sequence, the start/stop/run switch S1 is moved to its "stop" position. This de-energizes the second relay K2. This, in turn, opens the relay contact K2-2 connected to the reset terminal 4 of the timer IC1. This initiates the timing cycle once again and re-energizes the decompression solenoid 40. The energy stored in the capacitor C1 provides power to the timing circuit, comprised of the timer IC1, the resistor R4, and the capacitor C3. At the conclusion of the timing interval, the relay K1 is once again de-energized. This again deactivates the decompression solenoid 40. The entire sequence of events is illustrated in FIG. 2.

From the foregoing description, it will be observed that numerous variations and modifications may be effective without departing from the true spirit and scope of the novel concept of the invention. For example, the control circuit illustrated in FIG. 8 may be easily incorporated into an ESO control system. Switch S1 would be the so called "ignition switch". In addition, battery drainage or run-down is avoided by the operation of one switch. Finally, a distinct delay on start-up and shut-down can be provided for by suitable contacts, reistors and capacitors. It should be understood that no limitation with respect to the specific apparatus illustrated herein is intended or should be inferred. It is, of course, intended to cover by the appended claims all such modifications as fall within the scope of the claims.

We claim:

1. In an internal combustion engine having a combustion chamber, an exhaust valve, a drive shaft, a cam shaft driven by said drive shaft, and a rocker arm linkage for transmitting the rotation of said cam shaft to operate said exhaust valve, an unloading circuit, comprising:

(a) an electrical solenoid;

(b) camming means for operating said rocker arm linkage to hold said exhaust valve open in response to the energization of said electrical solenoid;

(c) an electrical time delay circuit for energizing said solenoid for a pre-selected time interval, said electrical time delay circuit including a first time delay relay for energizing said solenoid during the start-up and shut-down of said engine, and a second time delay relay for delaying the energization of said first time delay relay during the shut-down of said engine; and (d) switching means for energizing said electrical time delay circuit during the shut-down of said engine, said switching means including means for energizing said electrical circuit during the start-up and shut-down of said engine, whereby said engine on slowing down is allowed to rundown for a first pre-selected time interval while loaded and for a second pre-selected time interval while unloaded.

2. A control system for an internal combustion engine of a type having a combustion chamber and a valve for controlling the flow of fluid between said combustion chamber and the atmosphere, comprising:

(a) means for opening and closing said valve in response to the rotation of a control shaft to a pre-selected position;

(b) solenoid means for rotating said control shaft to said pre-selected position upon energization of an electrical solenoid;

(c) monostable means for energizing said solenoid for a pre-selected time interval, said monostable means including a reset terminal, a trigger terminal and an output terminal;

(d) a first relay which is energized in response to the output terminal of said monostable means and which includes a plurality of electrical contacts which are opened and closed in response to the operation of said relay, said electrical contacts including a first contact set which is connected to said solenoid such that said solenoid is energized when said monostable means is triggered and de-energized when said monstable means is reset, and a second contact set which are normally closed when said relay is not energized;

(e) three-position electrical switch means for supplying electrical power to trigger said monostable means when said switch means is in a start position and for supplying electrical power to reset said monostable means when said switch is in a run position; and (f) energy storage means, electrically in parallel with said monostable means, for storing power to operate said monostable means and to trigger said monostable means when said three-position switch means is moved between said run position and a position intermediate said start and said run positions, whereby said solenoid means is operated when said three-position switch means is in its start position, said solenoid means is de-energized when said three-position switch is in its run position and said solenoid means is re-energized when said three-position switch is between its start and its run positions after being in its run position.

3. The control system of claim 2, wherein said first relay includes normally open contact means for supplying power to said monostable means when said three-position electrical switch means is in its run position.

4. In an internal combustion engine having a combustion chamber, and a valve for controlling the flow of combustion gases from said combustion chamber to the atmosphere, a control system comprising:

(a) camming means for opening said valve in response to the rotation of a control shaft to a pre-selected position;

(b) a solenoid and solenoid means for rotating said control shaft to said pre-selected position upon the energization of said solenoid, said solenoid having an electrical armature and a plunger operated in response to the energization of said armature, and said solenoid means including a bell crank connecting said plunger with said control shaft;

(c) a time delay circuit for energizing said solenoid for a pre-selected time interval; and (d) electrical switch means for supplying electrical power to said time delay circuit when said engine is shutdown, whereby said engine is shut down with said combustion chamber vented to the atmosphere for a pre-selected period of time.

5. The control system of claim 1, wherein said engine includes: a drive shaft, a cam shaft which is rotated in response to said drive shaft, and rocker arm follower means for opening and closing said valve in sychronized relationship with the rotation of said engine drive shaft, and wherein said camming means includes a cam rotated by said control shaft, said cam being positioned to operate said rocker arm follower means to hold said valve open in response to the rotation of said control shaft.

6. The control system of claim 1, wherein said time delay circuit includes: a relay coil which is energized in response to said switch means, a plurality of electrical contacts which are opened and closed in response to the energization of said relay coil with one set of said contacts being electrically in series with said solenoid and said switch means, and an RC circuit for de-energizing said coil after said pre-selected time interval.

7. The control system of claim 1, wherein said electrical switch means comprises a a plurality of electrical contact pairs including one pair which is closed when said engine is started, said one pair being electrically in series with said solenoid.

8. The control system of claim 1, wherein said engine includes:

a throttle control for controlling the flow of fuel to said combustion chamber, said throttle control being adjustable between an up-position and a down-position; and wherein said time delay circuit includes an electrical limit switch having at least one set of contacts which are closed in one of said up-position and down-position of said throttle control.

9. The control system of claim 8, wherein said limit switch includes two sets of contacts, one set of which is closed when said throttle control is in its up-position and one set of which is closed when said throttle is in its down-position.

10. The control system of claim 1, wherein said switch means supplies power to said time delay circuit when said engine is started and when said engine is shut-down.

11. The control system setforth in claim 10, wherein said time delay circuit includes: a monstable; a first relay coil which is energized in response to the operation of said monostable; a plurality of electrical contacts which are opened and closed in response to the energization of said first relay coil with at least one set of normally open contacts being electrically in series with said solenoid means, and with at least one set of normally closed contacts; and wherein said electrical switch means includes a first switch having a start position for triggering said monostable into operation, said start position being electrically in series with said one set of normally closed contacts and said monostable.

12. The control system of claim 11, wherein said monostable defines a tripped condition and a reset condition such that said first relay coil is energized when said monostable is tripped and said first relay coil is de-energized when said monostable is reset.

13. The control system of claim 10, wherein said time delay circuit includes:

a monostable having an output terminal, a reset terminal, and a triggering terminal;

a first relay coil which is energized in response to the output terminal of said monostable, and a plurality of electrical contacts which are opened and closed in response to the energization of said first relay coil with one of said contacts being electrically in series with said solenoid means.

14. The control system of claim 13, wherein said electrical switch means includes: a three position switch defining a start position, a stop position and a run position, said start position supplying power to a start terminal; and wherein said plurality of electrical contacts includes a normally closed set of contacts that are electrically in series with said triggering terminal of said monstable and said start terminal of said three position switch.

15. The control system of claim 14, further including energy storage means, activated by said switch means, for keeping said monostable energized while said switch means is operated.

16. The control system of claim 13, wherein said electrical switch means includes:

a switched source of power having a start position wherein a start terminal is energized, a run position where a run terminal is energized and a stop position where said start terminal and said run terminal are de-energized;

a limit switch having one terminal connected to an electrical ground and a second terminal which is grounded and ungrounded in response to the operation of said limit switch; and a second relay coil connected between the run terminal of said switched source of power and the second terminal of said limit switch, said second relay coil operating a plurality of electrical contacts which are opened and closed in response to the energization and de-energization of said second relay coil, whereby said second relay coil is energized when said switch source of power is in its run position and said limit switch is closed.

17. The control system of claim 16, wherein said engine includes a throttle control for controlling the flow of fuel to said combustion chamber, said throttle control being adjustable between an up-position and a down-position; and wherein said limit switch is closed when said throttle control is in its up-position.

18. The control system of claim 17, wherein said second relay coil includes one set of contacts which are closed upon de-energization of said second relay coil and wherein said set of contacts are connected to the reset terminal of said monostable, whereby said solenoid means is de-energized when said throttle control is in its up-position and said switched source is power is in its run position.

* * * * *